United States Patent [19]

Dalmas

[11] 4,337,060

[45] Jun. 29, 1982

[54] METHOD OF BLEACHING TEXTILE MATERIALS

[75] Inventor: Edward A. Dalmas, Valdese, N.C.

[73] Assignee: Villar, Inc., Icard, N.C.

[21] Appl. No.: 275,108

[22] Filed: Jun. 18, 1981

[51] Int. Cl.[3] ..... D06L 3/02; D21C 9/16

[52] U.S. Cl. ..... 8/111; 252/186.28; 162/78

[58] Field of Search ..... 8/111; 252/186; 162/78

[56] References Cited

U.S. PATENT DOCUMENTS

| | | | |
|---|---|---|---|
| 2,333,916 | 11/1943 | Campbell et al. | 252/186 |
| 2,679,483 | 5/1954 | Armstrong | 252/186 |
| 2,927,082 | 3/1960 | Young | 8/111 |
| 3,150,918 | 9/1964 | Currier | 8/111 |
| 3,650,887 | 3/1972 | Grangaard | 162/78 |
| 3,996,151 | 12/1976 | Kirner | 252/186 |

*Primary Examiner*—Maria Parrish Tungol
*Attorney, Agent, or Firm*—Roy B. Moffitt

[57] ABSTRACT

Described is a method of bleaching textile fabrics with potassium based bleaching liquors: One liquor is an aqueous solution of commercially available potassium orthosilicate, water and hydrogen peroxide and the other is an aqueous solution of water, hydrogen peroxide, and the reaction products of sodium silicate and potassium hydroxide (potassium orthosilicate and sodium hydroxide) the relative concentrations of the reactants being such that there are four moles of potassium hydroxide for every one mole of sodium silicate. In the latter liquor, the potassium ion concentration is always greater than the sodium ion concentration.

15 Claims, No Drawings

METHOD OF BLEACHING TEXTILE MATERIALS

BACKGROUND OF THE INVENTION

1. Field of the Invention

This invention relates to a method of bleaching textile materials using potassium based bleaching liquors, both containing hydrogen peroxide and water. One liquor contains commercially available potassium orthosilicate, the other liquor contains the products of the reaction of potassium hydroxide and sodium silicate in such relative concentrations that the final liquor contains more potassium than sodium ions.

In the manufacture of cellulose fibers into a marketable product, either the fibers or the produce made from the fibers is often bleached to improve its appearance and make it more receptive to other manufacturing processes. Such bleaching is done with various oxidizing or reducing agents, an aqueous alkaline solution of hydrogen peroxide being presently the most successful and accepted method. Alkaline hydrogen peroxide solutions generally are not stable. Their decomposition rate must be controlled in any bleaching process in order to achieve desired results; it is known to use sodium silicate for this purpose. However, the use of sodium silicate per se has a number of disadvantages in most bleaching processes, manifesting themselves in the decomposition of insoluble calcium and magnesium silicate products on the equipment and on the goods being processed. Because of these problems, the textile industry has been looking for a cheap, relatively easy-to-handle composition that would achieve the desired bleaching results obtained using sodium silicate (water glass) and hydrogen peroxide without the undesirable deposition of insoluble calcium and magnesium silicate products.

2. Description of Prior Art

U.S. Pat. Nos. 2,927,082; 3,951,594; 3,150,918 and 3,353,093 are illustrative of the prior art relating to bleaching of textile cellulosic fibers and/or goods using a mixture of sodium silicate and hydrogen peroxide. The first-mentioned patent employs a magnesium salt, such as Epsom salt and magnesium-glyconate, whereas the second-mentioned patent discloses the use of sodium orthosilicate in combination with hydrogen peroxide and magnesium-polyphosphate stabilizers. Both of the last two mentioned patents teach a textile bleach liquor containing hydrogen peroxide, sodium silicate and caustic potash; however, the concentration of caustic potash is too small to achieve potassium orthosilicate.

SUMMARY OF THE INVENTION

The invention is a process of bleaching cellulose materials with potassium based bleach liquors: One liquor employs commercially available potassium orthosilicate, water and hydrogen peroxide, another employs the reaction products of KOH with $Na_2SiO_3$ (water glass), forming potassium orthosilicate and sodium hydroxide. The relative concentrations of $Na_2SiO_3$ and KOH are such that they are 4 moles of KOH for every mole of $Na_2SiO_3$. Such liquors have been found to eliminate the disadvantages experienced using sodium silicate and/or sodium orthosilicate but still retain advantages one would have if sodium silicate would have been used.

Cellulose fibers are mainly cotton and wood, cotton being used by the textile industry while the pulp and paper industry using mostly wood. The textile industry bleaches fibers, yarns, and fabrics made from such fibers and yarns, whereas the paper industry would usually bleach the wood fiber pulp per se.

An aqueous alkaline hydrogen peroxide bleaching solution is unstable, the peroxide decomposing very rapidly without the use of a stabilizer to control the rate of hydrogen peroxide decomposition and thus the rate and degree of bleaching. The prior art teaches stabilizers, such as sodium silicate, in combination with sodium hydroxide, sodium carbonate or sodium phosphates. Sodium silicate, which is silica in water solution, performs satisfactorily as a stabilizer; however, it forms insoluble complexes with calcium and magnesium and these insoluble complexes are very difficult to remove from the machinery, fabric and/or yarn. Furthermore, these complexes create dyeing problems after the bleaching process has been completed and impart a harsh feel, interferes with sewing operations and wet processing equipment.

Other forms of soluble silicates have been used in an attempt to avoid the problem of insoluble products, resulting from calcium and magnesium reacting with sodium silicate. However, such silicates cannot be supplied in easy-to-handle liquid form and must be dissolved at the time of use and used before they precipitate again if they are too concentrated. In addition, other stabilizers must be used with these silicates that are not as desirable and as cheap as sodium silicate.

Prior art bleaching solutions, using hydrogen peroxide, sodium silicate and sodium hydroxide, the sodium oxide in the sodium silicate and the sodium hydroxide will hydrolyze and saponify fats and fatty products from the cotton and turn them into rather hard to dissolve products. These products will have a tendency to combine with the calcium and magnesium in the bleach solution to create very hard to remove salts, resulting in difficulty in the subsequent dyeing process and the end use of the cellulose material.

Hydrogen peroxide type bleaches used with modifiers such as sodium silicate and sodium hydroxide must always be carried out in an alkaline medium with an ideal pH of above 10.5. In such instances, hydrogen peroxide bleach solutions contain sodium silicate in various amounts along with other stabilizers of organic and inorganic compositions. There are processes that use combinations of sodium silicates with alkaline phosphates and magnesium sulfates and magnesium-polyphosphates. Such procedures have not been readily adopted by the textile industry.

Sodium silicate in bleaching liquor is desirable, not only because it can be put into a water solution, stored and used when required, but it also has an advantage of an excellent detergent or scouring agent. The same is true for sodium hydroxide, sodium carbonate and alkaline phosphates. While such chemicals easily remove some undesirable materials from the products sought to be bleached, they also create problems with other materials they remove from cotton, mainly fatty products that form hard soap products referred to above. The above problems are still unsolved by prior art and it is the solution of these problems to which the instant invention is directed.

DESCRIPTION OF THE PREFERRED EMBODIMENTS

The bleaching liquors used by this invention all employ a potassium based silicate, namely, potassium orthosilicate. One liquor uses commercially available potassium orthosilicate, the other reacts KOH and $Na_2SiO_3$ to form it, the relative concentrations of the reactants being such that there are 4 moles of KOH for every mole of $Na_2SiO_3$.

Liquor No. 1

The first bleaching liquor contains potassium orthosilicate ($K_4SiO_4H_20$), which can be acquired from Diamond Shamrock Company, Cincinnati, Ohio. To the potassium orthosilicate is added water then hydrogen peroxide. The cellulosic materials, fibers or cloth, are immersed in this liquor, allowed to seep (heating can be employed to speed the bleaching process) and rinsed.

Liquor No. 2

The second bleaching liquor requires that sodium silicate (water glass), preferably 42° Bé ($Na_2SiO_3$ and water), be first mixed and thus reacted with potassium hydroxide (KOH) to form potassium orthosilicate as follows:

$$Na_2SiO_3+4KOH \rightarrow K_4SiO_4H_2O+2NaOH$$

It will be noted that it is necessary to have at least 4 moles of KOH for every mole of $Na_2SiO_3$. Preferably, the resulting $K_4SiO_4H_2O$ and 2NaOH are subsequently mixed with water and hydrogen peroxide, the cellulosic fibers or products immersed in the last-mentioned solution, allowed to seep (heating can be used to speed the bleachng process) and rinsed.

Water glass having $Na_2O$ to $SiO_2$ ratio of 1 to 2.5 up to 1 to 3.2 inclusive may be used. Preferably, it is reacted with potassium hydroxide as above described prior to mixing it with the hydrogen peroxide; however, all ingredients may be mixed simultaneously with water. Any water soluble silicate and potassium hydroxide combination that can provide a final solution of more potassium than sodium ions is operable. Water soluble potassium silicates, potassium orthosilicates and potassium phosphates may be used in bleaching liquors employing sodium silicate to insure the above-described sodium-potassium ion relationship. Furthermore, dipotassium disodium orthosilicate $K_XNa_YSiO_4H_2O$, e.g. $K_2Na_2SiO_4H_2O$ may be used in lieu of potassium orthosilicate, where X equals 4 moles $K^+$ to 1 mole $Na^+$ and Y equals 1 mole $Na^+$ to 4 moles $K^+$.

The potassium orthosilicate and/or the dipotassium disodium orthosilicate prevent the formation of the hard soap and complex products with magnesium and calcium ions as experienced by prior art bleaching liquors.

Bleaching of cellulose fibers in hydrogen peroxide requires an alkaline medium, properly stabilized to control the decomposition of the bleaching agent. An ideal balance requires enough alkali to satisfy the bleaching requirements demanded by the cellulosic fibers and an excess thereover to maintain a proper pH for the particular bleaching process.

U.S. Pat. No. 2,927,082 teaches the use of magnesium-glyconate to secure a properly balanced (pH) solution. However, potassium orthosilicate will also produce a desired bleaching effect without the use of magnesium products, or for that matter, organic stabilizers, sequestrants (chelating agents), or phosphate compounds. This is not to say that the use of such items is precluded in the two types of bleach liquors previously described.

EXAMPLE 1

2500 kg of tubular knitted cotton and polyester-cotton goods (65% to 35% blend) were bleached in the following bleach formulation: 37.5 kg of potassium orthosilicate or KOH reacted with $Na_2SiO_3$ to form $K_4SiO_4H_2O+2NaOH$ (1.5 weight percent based on weight of goods), 15.75 kg of wetting agent, 25.0 kg of 50% hydrogen peroxide and 10,000 liters of water. The above-identified ingredients were formulated for prebleaching prior to dyeing by the atmosphere beck process. The fabric and solution were loaded into a batch kier without a saturator, heated to 65° C. over 1 hour, circulated 5 hours at 65° C. The bleach solution was then dropped and the fabric rinsed and unloaded through a counter-flow washer with water flowing at 133 liters per minute at 60° C. The fabric was soft, absorbent, mote-free and dyed without any resist spots.

EXAMPLE 2

2500 kg of tubular knit cotton and polyester-cotton goods were used having a 65% to 35% blend, employing a batch kier. The bleach formulation consisted of 75 kg of potassium orthosilicate or KOH reacted with $Na_2SiO_3$ to form $K_4SiO_4H_2O+2NaOH$ (3.86 weight percent based on weight of goods), 18.75 kg wetting agent; 6.5 kg of sequestrant; 12.5 kg of fluorescent agent, 100 kg of 50% hydrogen peroxide, and 10,000 liters of water. The fabric and solution were loaded into a batch kier without a saturator, heated to 76° C. over 1.5 hours, and circulated 5 hours at 76° C. The bleach solution was then removed and the fabric rinsed and unloaded through a counterflow water with water flowing at 150 liters per minute at 60° C. The fabric was a full white, soft, absorbent and mote free. The entire kier load was finished and dried in a normal manner, the finished fabric being uniform high white with excellent sewability.

EXAMPLE 3

Tubular knit cotton goods were bleached in a continuous kier type J, employing a bleach formula of the following composition: 150 kg of potassium orthosilicate or KOH reacted with $Na_2SiO_3$ to form $K_4SiO_4H_2O+2NaOH$ (3.75 percent based on weight of water), 30 kg wetting agent, 20 kg fluorescent agent, 140 kg of 50% hydrogen peroxide, and 4,000 liters of water. Dry, greige goods were continuously saturated with the bleach solution and pile into a continuous J-type kier where they were heated with inspirated steam to 80° C. in 45 minutes. The heated goods were then thoroughly saturated with a solution 75% weaker than the original solution and heated to 80° C. for another 45 minutes. For the purpose of this example, a 75% weaker solution means that the residual chemicals were circulated with no additions during continuous operation. The goods were then rinsed continuously through a counter-flow washer with water flowing 150 liters per minute at 60° C. The goods were then finished and dried in a normal manner. They were soft and having a uniform high white and excellent sewability.

EXAMPLE 4

500 kg of cotton package yarn (18/1) was bleached under 6 kg pressure in a bleach kier. The solution was composed of the following: 17.5 kg of potassium orthosilicate or KOH reacted with $Na_2SiO_3$ to form $K_4SiO_4H_2O+2NaOH$ (3.5% based on weight percent of goods); 2.0 kg of wetting agent; 2.5 kg of fluorescent agent; 2.0 kg of 50% hydrogen peroxide; 3500 liters of water.

The yarn was loaded into the kier, charged with the above solution, heated to 140° C. under pressure for 25 minutes, cooled to 95° C., dropped, washed once at 80° C., washed again at 60° C., then neutralized at 45° C. with 55 grams of 56% acetic acid. The yarn was then extracted and dried in a normal manner. The finished yarn was softer than normal, having a uniform white color and absorbent body.

In all of the above examples where KOH was reacted with $Na_2SiO_3$ to form $K_4SiO_4H_2O$, the molar ratio of KOH to $Na_2SiO_3$ was no less than 4 to 1.

Modifications and variations of the present invention are possible in light of the above teachings and, therefore, within the scope of the appended claims the invention may be practiced otherwise than described.

What is claimed is:

1. A method of bleaching cellulosic materials comprising:

(a) providing a bleach liquor composed of water, hydrogen peroxide and potassium orthosilicate;

(b) immersing the cellulosic materials in the bleach liquor of step (a);

(c) separating the bleach liquor from the cellulosic materials and drying same.

2. The method of claim 1 wherein the immersed cellulosic material is heated to at least 65° C.

3. The method of claim 2 wherein the heated cellulosic material is simultaneously subjected to pressure in excess of atmospheric and the temperature is at least 140° C.

4. The method of claim 2 wherein the heating is accomplished by steam.

5. The method of claim 1 wherein the concentration of potassium orthosilicate is at least 1.5 weight percent of the cellulosic materials.

6. A method of bleaching cellulosic materials comprising:

(a) providing potassium orthosilicate by reacting at least 4 moles of potassium hydroxide with at least 1 mole of $Na_2SiO_3$;

(b) mixing the potassium orthosilicate of step (a) with water and hydrogen peroxide to form a bleach liquor;

(c) immersing the cellulosic materials in the bleach liquor;

(d) separating the bleach liquor from the cellulosic materials and drying same.

7. The method of claim 6 wherein the immersed cellulosic material is heated to at least 65° C.

8. The method of claim 7 wherein the heated cellulosic material is simultaneously subjected to pressure in excess of atmospheric and the temperature is at least 140° C.

9. The method of claim 7 wherein the heating is accomplished by steam.

10. The method of claim 6 wherein the concentration of potassium orthosilicate is at least 1.5 weight percent of the cellulosic materials.

11. A method of bleaching cellulosic materials comprising:

(a) providing a bleach liquor by mixing water and hydrogen peroxide with potassium hydroxide and sodium silicate in such amounts that for every mole of $Na_2SiO_3$ there are at least 4 moles of KOH so as to form potassium orthosilicate;

(b) immersing the cellulosic materials in the bleach liquor of step (a);

(c) separating the bleach liquor from the cellulosic materials and drying same.

12. The method of claim 11 wherein the immersed cellulosic material is heated to at least 65° C.

13. the method of claim 12 wherein the heated cellulosic material is simultaneously subjected to pressure in excess of atmospheric and the temperature is at least 140° C.

14. The method of claim 12 wherein the heating is accomplished by steam.

15. The method of claim 11 wherein the concentration of potassium orthosilicate is at least 1.5 weight percent of the cellulosic materials.

* * * * *